United States Patent [19]

Brouthers

[11] 4,219,954

[45] Sep. 2, 1980

[54] FIREARM

[75] Inventor: Paul E. Brouthers, Monson, Mass.

[73] Assignee: D. W. A. Associates, Monson, Mass.

[21] Appl. No.: 929,571

[22] Filed: Jul. 31, 1978

[51] Int. Cl.[3] ..... F41C 1/00

[52] U.S. Cl. ..... 42/67

[58] Field of Search ..... 42/67, 65

[56] References Cited

U.S. PATENT DOCUMENTS

| | | | |
|---|---|---|---|
| 655,844 | 8/1900 | Wesson | 42/67 |
| 2,863,249 | 12/1958 | Koucky et al. | 42/67 |
| 3,654,720 | 4/1972 | Ruger | 42/65 |
| 3,768,190 | 10/1973 | Ruger et al. | 42/65 |
| 3,918,189 | 11/1975 | Hartog | 42/67 |

*Primary Examiner*—Charles T. Jordan

*Attorney, Agent, or Firm*—Wolf, Greenfield & Sacks

[57] ABSTRACT

A firearm that is preferably a revolver has an improved gain bolt construction, particularly for use in larger caliber weapons such as a 44 Magnum revolver. The gain bolt design indirectly assists the hand in particular in the final indexing of the cylinder. The revolver comprises a frame, a hand grip, a trigger, a hammer, a cylinder, and a hand arrangement for operating the cylinder. The trigger is pivotally supported in the frame and has a front flange for operating the bolt which is selectively moveable upon operation of the trigger to permit rotation of the cylinder and lock the cylinder in predetermined positions. The bolt is supported in a compartment forward of the trigger. The bolt includes a forward pivot end, a rear end engaged by a flange of the trigger, and a top lug which is adapted to be selectively locked with a slot in the cylinder in predetermined positions of the cylinder.

19 Claims, 5 Drawing Figures

FIREARM

BACKGROUND OF THE INVENTION

The present invention relates in general to a firearm, and particularly to a revolver. The invention is directed to the bolt construction of the revolver, and in particular to a bolt construction for use with larger caliber weapons such as a 44 Magnum revolver which may be a service revolver or a target revolver. The cylinder of a typical revolver includes, for example, six passages, each for receiving a bullet to be fired from the weapon. In most revolvers, it is common to provide a locking slot in the periphery of the cylinder which is locked by the bolt prior to firing. This locking slot is commonly provided in an aligned position in relationship to the bullet accommodating passage. For smaller caliber weapons, this arrangement is suitable. However, for larger caliber weapons wherein the chamber cartridge is larger, a slot that aligns with the passage provides a weakened area because of the thinness of the wall of the cylinder in the area of the chamber. In some revolver constructions the bolt is made with a relatively complex construction so that the bolt can be offset but still maintained in an upright position. This enables the slot in the cylinder to be disposed in an area of the cylinder having a thicker wall spaced from the first wall portion defined adjacent the chamber.

Accordingly, one main object of the present invention is to provide an improved bolt construction preferably for a revolver and which is a relatively simple construction yet providing a construction that enables the construction of an improved cylinder that is not characterized by weakened areas because of bolt accommodating slots that are maintained too close to the chamber.

Another object of the present invention is to provide an improved bolt construction that is of relatively simple design and that does not require complex pivoting structure for support of the bolt.

A further object of the present invention is to provide an improved bolt construction particularly for a revolver and more particularly for a revolver for larger caliber ammunition such as a 44 Magnum revolver.

Another object of the present invention is to provide an improved bolt construction for a revolver that does not involve increasing the width of the frame of the revolver.

Still another object of the present invention is to provide an improved bolt construction for a revolver that assists the hand in the indexing of the cylinder.

Still a further object of the present invention is to provide an improved bolt construction for a revolver which is of relatively simple design, which may be assembled in the weapon quite easily, which is constructed essentially in only a single piece including the pivoting thereof, and which can be maintained quite easily.

SUMMARY OF THE INVENTION

To accomplish the foregoing and other objects of this invention, there is provided a firearm comprising a frame, a trigger, means mounting the trigger in the frame, and the improvement of the present invention which resides primarily in an improved bolt and cylinder construction. The improvement of the present invention is particularly suited for larger caliber firearms such as a Magnum 44 revolver. The bolt comprises a base which is operated by the trigger and includes pivot means from which the bolt pivots when being operated by the trigger. The bolt has a locking lug means which comprises a substantially planar wall extending from the base of the bolt and at an obtuse angle thereto. Essentially, the bolt is tilted or skewed so that it is possible to provide the accommodating slot in the cylinder at a point that is substantially spaced from the weakest wall section that is defined along a cylinder radius passing through the center of each passage for accommodating a bullet in the cylinder. The cylinder preferably has, for example, six such passages, each having associated therewith a locking slot spaced from the cylinder radius that passes through the center of the passage. The slots are each directed, having their axis disposed at an acute angle to the cylinder radius. This angle corresponds to the angle of skew of the bolt or at least the locking portion of the bolt. The locking lug of the bolt preferably has an arcuate tapered top edge with the slot in the cylinder having a corresponding configuration. The bolt is not pivoted by means of separate pivot pins or the like, but is instead provided with a stud preferably integral with the bolt and preferably of triangular cross-section disposed at a forward end of the bolt. The frame has a slot therein which guides the wall defining the lug and there is also provided biasing means cooperating with the base of the bolt for normally biasing the lug into the slot of the cylinder. Preferably, the cylinder is supported by a crane having a lower crane leg supporting this biasing means which cooperates with the bolt.

DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
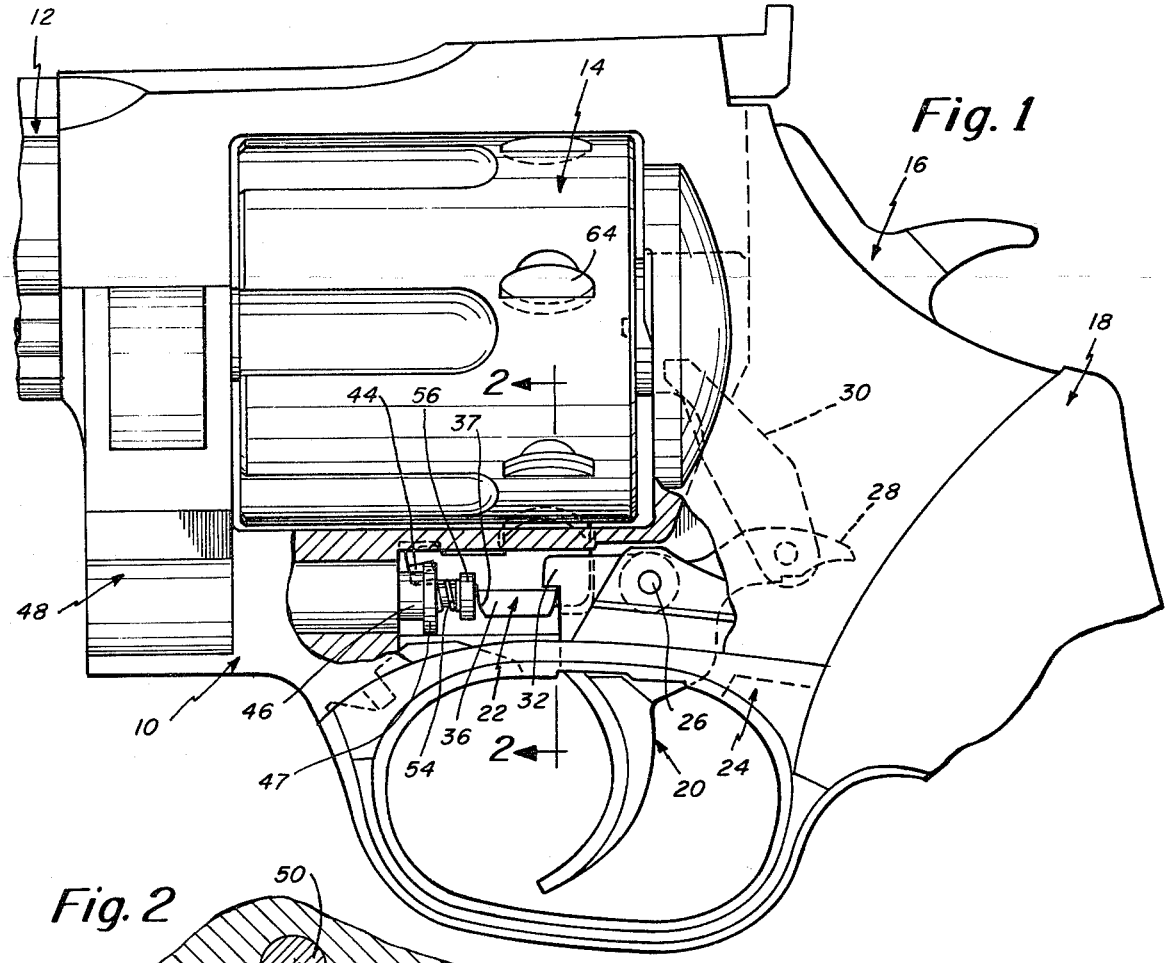
FIG. 1 is a side elevation view partially cut away of a preferred embodiment of the firearm of the present invention as embodied in a revolver.

The drawings show a preferred embodiment of the present invention as depicted in a revolver construction which may be a double-action revolver comprising a frame 10, a barrel 12, a cylinder 14, a hammer 16, a hand grip 18, and a trigger 20. The principle improvement in accordance with this invention resides in the construction of the bolt 22 which is shown in its normal locked position in FIGS. 1-3, in an unlocked position in FIG. 4, and along in a perspective view in FIG. 5. Because the present invention is directed primarily to the bolt and cylinder construction improvement, this description is limited primarily to those portions of the weapon. For a more complete description of the overall operation of a weapon of this type, refer to my copending application Ser. No. 913,644 filed June 8, 1978.

The trigger 20 is supported in a trigger guard assembly 24 which may be a removeable trigger guard assembly. The support for the trigger 20 is by means of pin 26 shown in FIG. 1 which couples through a pair of ears of the frame of the trigger guard assembly. The trigger 20 includes flange 28 from which the hand 30 is pivotally supported. The hand 30 operates an actuator or extractor associated with the cylinder 14 for selectively rotating the cylinder to approximately an angle of 60°. The hand and actuator arrangement may be conventional or may be of the type shown in my copending application Ser. No. 913,644. The trigger 20 also includes a front flange 32 adapted to operate the bolt 22, and in particular by engaging the base 36 of the bolt.

Figure 2:
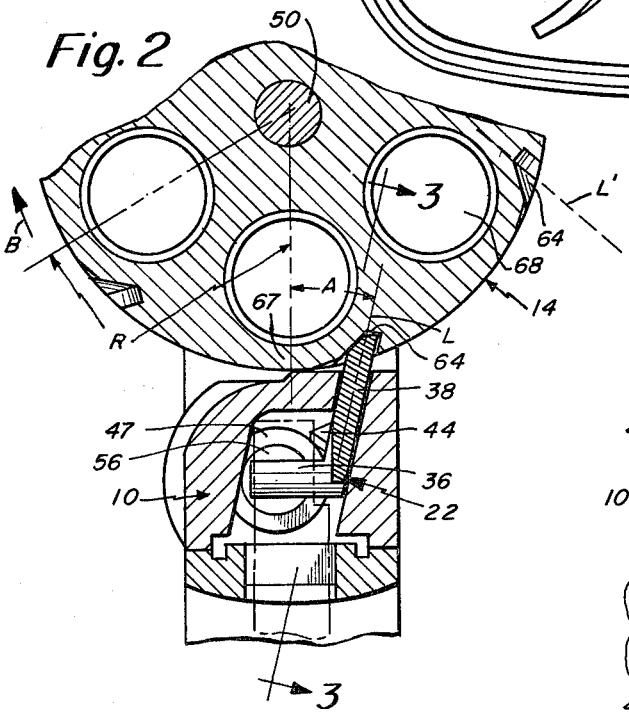
FIG. 2 is a cross-sectional view, through the bolt, cylinder and a portion of the frame as taken along line 2—2 of FIG. 1.

In addition to the base 36 of the bolt 22, the bolt also includes a top lug 38 having a tapered top edge 40 disposed in an arcuate configuration. The forward end 42 of the bolt is the end from which the bolt pivots by means of the stud 44 functioning in cooperation with the lower crane leg 46 which is supported in the frame 10. The lower crane leg 46 is a part of the crane 48 which also includes an upper crane leg 50 (see FIG. 2) for supporting the cylinder 14. The lower crane leg 46 is provided with a flange 47 as depicted in FIG. 2 and against which the triangular-shaped stud 44 rests. It is the cooperation of the stud 44 with the flange 47 that provides a pivoting action. This pivoting is also provided primarily by the interaction of the upwardly extending portion of end 42 into the channel 43 in the section of the frame 10 depicted in, for example, FIGS. 3 and 4.

The bolt 22 has a biasing force applied thereto by means of the spring 54 and associated bolt plunger 56 most clearly illustrated in FIG. 1. The plunger 56 may fit within an accommodating recess in the lower crane leg 46 and the spring 54 biases the plunger 56 against the side 37 of the base 36. This biasing force provides a positive interlocking between the trigger and the base of the bolt. The frame also has a channel 60 which is skewed from the vertical as depicted in FIG. 2. The channel 60 is for accommodating the lug 38 of the bolt.

Figure 3:
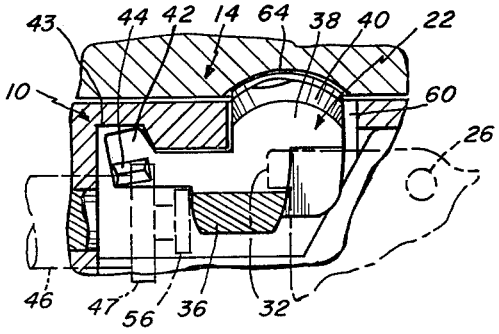
FIG. 3 is a further cross-sectional view taken along line 3—3 of FIG. 2 with the bolt in its locked position in relationship to the cylinder.

FIGS. 1–3 show the bolt in its locked position in relationship to the cylinder 14. In this position, the lug 38 is locked in the slot 64 of the cylinder. The cylinder depicted in FIG. 1 is for accommodating six cartridges in the chambers 68. Each passage 68 is centered on a radius R of the cylinder 14 as depicted in FIG. 2. The center line L of the lug 38 as also depicted in FIG. 2 does not correspond with a radius R of the cylinder as would be the case in a conventional construction. Instead, the skewed lug 38 extends along a center line L, cuts through a chord of the cylinder 14, and passes through an adjacent passage 68 as shown by the dotted line in FIG. 2.

The skew of the center line L of the lug 38 also corresponds with a center line of the slot 64 also shown in FIG. 2 as the center line L'. These center lines L and L', of course, only correspond in direction when considering the slot into which the lug is locked.

Figure 4:
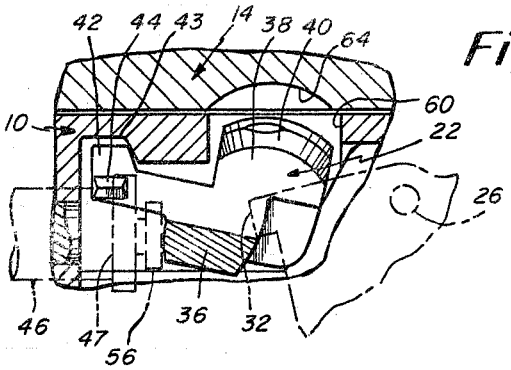
FIG. 4 is a cross-sectional view substantially the same as the view shown in FIG. 3 but with the bolt unlocked or withdrawn from the cylinder permitting rotation of the cylinder.
Figure 5:
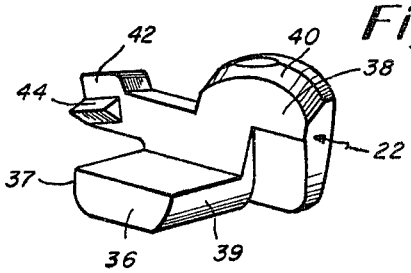
FIG. 5 is a perspective view of the bolt construction of the present invention.

FIGS. 1 and 3 depict the trigger in its normal position with the base 36 of the bolt extending substantially horizontally with the top surface of the base 36 extending substantially parallel to the outer surface of the cylinder. FIG. 4 depicts the position of the bolt and trigger with the trigger partially pulled sufficiently to pivot the bolt so that the lug 38 moves outwardly of its accommodating channel 64. The firearm is constructed so that during this initial pulling of the trigger the hand 30 has not yet actuated the extractor of the cylinder. Once the lug is clear of the cylinder as depicted in FIG. 4, then the hand 30 rotates the cylinder upon further pulling of the trigger 20. Further pulling of the trigger disengages the flange 32 of the trigger from the base 36 and under the bias of spring 54 the bolt snaps upwardly to a position depicted in FIG. 3 interlocking with its accommodating next slot in the cylinder. In that position of trigger pull, flange 32 is then resting at least partially under the base 36 of the bolt. At that point the cylinder is again locked and with slight further pull of the trigger, the hammer is disengaged for firing. After the trigger is released the flange 32 rides up on the surface 39 of the bolt (See FIG. 5) and the mechanism then assumes the position shown in FIG. 1 with the lug 38 locked in the slot 64. Thus, each time that the trigger is pulled the cylinder is rotated to the next position, locked in that position, and then the firing sequence occurs thereafter.

The pivoting action of the bolt as depicted in the positions of FIGS. 3 and 4, occurs by interaction of the stud 44 with the lower crane leg. There is thus no additional piece that is necessary such as a pin that is sometimes used through the frame for securing the bolt in a pivoting position. The configuration of the bolt and the accommodating channels in the frame maintain the bolt in position and yet pivotal upon operation of the trigger.

It can be seen from FIG. 2 that the slots 64, such as the one in which the lug 38 is disposed in FIG. 2, are in an area spaced from the radius R and away from the weakened wall section 67 shown in FIG. 2. Furthermore, with the skewed lug, the slot does not extend toward its accommodating passage but essentially extends in a direction spaced from its associated passage and substantially tangential thereto.

In FIG. 2 the relatively small acute angle A defined between the radius R and the center line L is on the order of 13°. It has been found that a desirable range for this angle is between 8° and 18°. If the angle A is made too small, then the accommodating slot 64 is in a weakened area such as area 67 shown in FIG. 2. On the other hand, if the angle A is made too large, then there is not sufficient locking action between the bolt and cylinder.

The skewed arrangement of the lug of the bolt also functions to center the cylinder 14 more accurately with regard to the frame which, of course, is important. The lug 38 is provided with a tapered wall 40 that provides the type of wedge so that even if the cylinder 14 is not rotated totally accurately to the next position, the lug 38 when sliding into the slot 64 centers the cylinder quite accurately with regard to the frame. This type of action is not characteristic of prior art bolt arrangements, especially those employing a straight slotted cylinder.

Having described one embodiment of the present invention, it should now become apparent to those skilled in the art that numerous other embodiments may be contemplated as falling within the scope of this invention. For example, in the embodiment disclosed herein, the cylinder 14 is depicted as of the type rotatable in the direction shown by the arrow B in FIG. 2 from position to position. In an alternate arrangement the lug may be skewed to the other side of the center line of the frame, particularly for a weapon having the cylinder rotating in a direction opposite to the direction B shown in FIG. 2.

One of the important features of the present invention is the ability of the bolt construction of this invention to actually assist in cylinder rotation. In this connection the hand 30, which is the primary mover with regard to rotation of the cylinder is responsible for the initial movement of the cylinder, but, once the hand has operated and prior to firing, when the bolt lug 38 moves upwardly into the cylinder passage, the tapered wall 40 against the tapered wall of the passage 64 provides a final rotation and accurate aligning of the cylinder relative to the frame. This arrangement in combination with the angular skewing of the lug 38 provides a greater assistance in this final cylinder rotation than was the case with former bolt constructions wherein the bolt was on the center line of the cylinder.

What is claimed is:

1. A firearm comprising;

a frame, a trigger, means mounting the trigger in the frame, a bolt supported in the frame adjacent the trigger having pivot means at one end, a trigger-engageable end and locking lug means, a cylinder mounted in the frame and having a plurality of cartridge-accommodating passages spacedly disposed along a circular locus having the passages centered along equally spaced respective cylinder radii, said cylinder having a slot for receiving the lug means of the bolt, a slot being associated with each passage, but spaced away from the cylinder radius to the center of the passage, said locking lug means comprising a substantially planar lug disposed at a relatively small angle to the vertical center plane of the frame.

2. A firearm as set forth in claim 1 wherein said trigger has a finger-engageable side external of the frame and a support side within the frame having a pivot support and flange means engageable with the bolt trigger-engageable end.

3. A firearm as set forth in claim 2 including means coupled from the trigger for causing partial selective rotation of the cylinder in the frame.

4. A firearm as set forth in claim 1 wherein said bolt has a base and said lug is defined by a wall extending from the base and at an obtuse angle thereto.

5. A firearm as set forth in claim 4 wherein said lug has an arcuate tapered top edge.

6. A firearm as set forth in claim 4 wherein said pivot means includes at least a stud integral with the bolt and at a forward end of the bolt when in place in the frame.

7. A firearm as set forth in claim 1 including support means for the bolt including a slot in the frame for guiding the wall defining the lug and biasing means cooperating with the base of the bolt for normally biasing the lug into the slot of the cylinder.

8. A firearm as set forth in claim 1 including a crane for supporting the cylinder and having a lower crane leg supporting biasing means cooperating with the bolt.

9. A firearm as set forth in claim 8 wherein the pivot means of the bolt means on the bolt fitting about the crane leg for pivoting from the crane leg.

10. A firearm as set forth in claim 8 wherein the means on the bolt for forming a pivot includes a triangular-shaped stud.

11. A firearm as set forth in claim 4 wherein the slots in the cylinder are equally disposed about the periphery thereof, each slot having an axis disposed at an acute angle to the cylinder radius.

12. A firearm as set forth in claim 1 wherein the slots in the cylinder are equally disposed about the periphery thereof, each slot having an axis disposed at an acute angle to the cylinder radius.

13. For a firearm having a frame, a bolt, a cylinder supported in the frame and a trigger, the improvement in the bolt construction and cylinder construction particularly for larger caliber firearms of a bolt having a base operated by the trigger and a cylinder locking lug defined by a wall extending from the base and at an obtuse angle thereof, said cylinder having peripherally disposed slots for selectively receiving the locking lug each slot having an axis disposed at an acute angle to the cylinder radius.

14. A firearm as set forth in claim 13 wherein said trigger has a finger-engageable side external of the frame and a support side within the frame having a pivot support and flange means engageable with the bolt trigger-engageable end.

15. A firearm as set forth in claim 14 including means coupled from the trigger for causing partial selective rotation of the cylinder in the frame.

16. A firearm as set forth in claim 13 including support means for the bolt including a slot in the frame for guiding the wall defining the lug and biasing means cooperating with the base of the bolt for normally biasing the lug into the slot of the cylinder.

17. A firearm as set forth in claim 13 including a crane for supporting the cylinder and having a lower crane leg supporting biasing means cooperating with the bolt.

18. A firearm as set forth in claim 17 wherein the pivot means of the bolt means on the bolt fitting about the crane leg for pivoting from the crane leg.

19. A firearm as set forth in claim 17 wherein the means on the bolt for forming a pivot includes a triangular-shaped stud.

* * * * *